US010326219B2

(12) United States Patent
Youtsey

(10) Patent No.: US 10,326,219 B2
(45) Date of Patent: Jun. 18, 2019

(54) CONNECTOR WITH A LOCKING MECHANISM, MOVEABLE COLLET, AND FLOATING CONTACT MEANS

(71) Applicant: PCT International, Inc., Mesa, AZ (US)

(72) Inventor: Timothy L. Youtsey, Tempe, AZ (US)

( * ) Notice: Subject to any disclaimer, the term of this patent is extended or adjusted under 35 U.S.C. 154(b) by 0 days.

(21) Appl. No.: 15/898,247

(22) Filed: Feb. 16, 2018

(65) Prior Publication Data

US 2018/0175519 A1 Jun. 21, 2018

Related U.S. Application Data

(62) Division of application No. 15/711,170, filed on Sep. 21, 2017, now Pat. No. 10,153,563.

(60) Provisional application No. 62/397,912, filed on Sep. 21, 2016.

(51) Int. Cl.

| | |
|---|---|
| ***H01R 9/05*** | (2006.01) |
| ***H01R 13/627*** | (2006.01) |
| ***H01R 13/639*** | (2006.01) |
| ***H01R 13/641*** | (2006.01) |
| *H01R 103/00* | (2006.01) |
| *H01R 24/40* | (2011.01) |

(52) U.S. Cl.

CPC ..... *H01R 9/0518* (2013.01); *H01R 13/6277* (2013.01); *H01R 13/639* (2013.01); *H01R 13/641* (2013.01); *H01R 24/40* (2013.01); *H01R 2103/00* (2013.01)

(58) Field of Classification Search

CPC ..... H01R 9/0518; H01R 13/6277; H01R 13/639; H01R 24/40

USPC ..... 439/585

See application file for complete search history.

(56) References Cited

U.S. PATENT DOCUMENTS

| | | | | |
|---|---|---|---|---|
| 3,199,061 | A | 8/1965 | Johnson et al. | |
| 4,377,320 | A | 3/1983 | Lanthrop et al. | |
| 4,990,106 | A | 2/1991 | Szegda | |
| 5,393,244 | A | 2/1995 | Szegda | |
| 5,466,173 | A | 11/1995 | Down | |
| 5,498,175 | A | 3/1996 | Yeh et al. | |
| 5,501,616 | A | 3/1996 | Holliday | |
| 5,564,938 | A * | 10/1996 | Shenkal | H01R 13/6397 439/133 |
| 5,879,191 | A | 3/1999 | Burris | |
| 6,010,289 | A | 1/2000 | Distasio et al. | |
| 6,042,422 | A | 3/2000 | Youtsey | |

(Continued)

FOREIGN PATENT DOCUMENTS

| | | | |
|---|---|---|---|
| DE | 202004000165 | U1 | 5/2005 |
| WO | 2007055871 | A1 | 5/2007 |

*Primary Examiner* — Alexander Gilman

(74) *Attorney, Agent, or Firm* — Thomas W. Galvani, P.C.; Thomas W. Galvani

(57) ABSTRACT

A coaxial cable termination device including a barrel having opposed front and rear ends, a collet at the front end of the barrel, and a sleeve mounted over the barrel for reciprocal movement. The sleeve moves between a retracted position, in which the sleeve allows compression of the collet, and an advanced position, in which the sleeve urges compression of the collet. In some embodiments, a locking mechanism locks the sleeve into either of the advanced and retracted positions. In some embodiments, contact means carried loosely within the device maintain contact between the barrel and a mating post to which the device is applied.

8 Claims, 5 Drawing Sheets

(56) References Cited

U.S. PATENT DOCUMENTS 6,210,222 B1 * 4/2001 Langham ..... H01R 9/0518 439/578
6,379,183 B1 * 4/2002 Ayres ..... H01R 9/0515 439/578
6,425,782 B1 7/2002 Holland
6,648,683 B2 11/2003 Youtsey
6,712,631 B1 3/2004 Youtsey
6,767,248 B1 7/2004 Hung
6,971,912 B2 * 12/2005 Montena ..... H01R 9/05 439/578
7,144,272 B1 12/2006 Burris et al.
7,288,002 B2 10/2007 Rodrigues et al.
7,364,462 B2 4/2008 Holland
7,377,809 B2 5/2008 Dyck
7,404,373 B2 7/2008 Youtsey
7,510,432 B2 3/2009 Entsfellner
7,527,524 B1 5/2009 Coleman et al.
7,753,727 B1 7/2010 Islam et al.
7,934,953 B1 5/2011 Solis
7,976,339 B2 7/2011 Buck et al.
7,997,930 B2 8/2011 Ehret et al.
8,029,316 B2 10/2011 Snyder et al.
8,272,893 B2 * 9/2012 Burris ..... H01R 9/0524 439/578
8,287,310 B2 * 10/2012 Burris ..... H01R 24/40 439/578
8,444,433 B2 5/2013 Snyder et al.
8,469,739 B2 6/2013 Rodrigues et al.
8,579,658 B2 11/2013 Youtsey
8,585,439 B2 11/2013 Amidon et al.
8,690,603 B2 4/2014 Bence et al.
8,753,147 B2 6/2014 Montena
8,840,429 B2 9/2014 Thomas et al.
8,882,250 B2 11/2014 Youtsey
8,894,440 B2 11/2014 Rodrigues et al.
8,915,751 B2 12/2014 Wood
8,944,846 B2 2/2015 Lee
9,039,446 B2 5/2015 Youtsey
9,040,822 B2 * 5/2015 Nieto Lopez ..... H02G 1/00 174/138 F
9,071,019 B2 6/2015 Burris et al.
9,083,113 B2 * 7/2015 Wild ..... H01R 13/623
9,130,281 B2 * 9/2015 Phillips, Jr. ..... H01R 9/0524
9,136,654 B2 * 9/2015 Matzen ..... H01R 24/38
9,147,963 B2 * 9/2015 Balcer ..... H01R 9/0524
9,240,636 B2 * 1/2016 Youtsey ..... H01R 13/622
9,257,780 B2 2/2016 Thomas et al.
9,496,661 B2 11/2016 Purdy et al.
9,722,330 B2 8/2017 Edmonds
9,768,566 B2 * 9/2017 Wilson ..... H01R 9/0524
10,033,122 B2 * 7/2018 Burris ..... H01R 9/0521
2002/0164900 A1 11/2002 Youtsey
2003/0114112 A1 6/2003 Strater et al.
2004/0048514 A1 3/2004 Kodaira
2005/0148236 A1 7/2005 Montena
2006/0015921 A1 1/2006 Vaughan
2007/0026735 A1 * 2/2007 Pyron ..... B60R 16/0222 439/584
2008/0003873 A1 * 1/2008 Henningsen ..... H01R 9/0521 439/578
2009/0053928 A9 2/2009 Entsfellner
2010/0125877 A1 5/2010 Wells et al.
2010/0223651 A1 9/2010 Wang
2010/0233901 A1 * 9/2010 Wild ..... H01R 13/6277 439/578
2010/0233902 A1 * 9/2010 Youtsey ..... H01R 24/40 439/578
2010/0261380 A1 10/2010 Skeels et al.
2010/0261381 A1 * 10/2010 Montena ..... H01R 9/032 439/584
2010/0297875 A1 11/2010 Purdy et al.
2011/0287653 A1 * 11/2011 Youtsey ..... H01R 4/26 439/345
2012/0021642 A1 1/2012 Zraik
2012/0108098 A1 * 5/2012 Burris ..... H01R 13/639 439/345
2012/0252268 A1 * 10/2012 Zraik ..... H01R 13/622 439/584
2012/0270439 A1 10/2012 Tremba et al.
2012/0289079 A1 * 11/2012 Amidon ..... H01R 13/6584 439/489
2012/0295466 A1 * 11/2012 Youtsey ..... H01R 13/639 439/320
2012/0329311 A1 12/2012 Duval et al.
2013/0130543 A1 * 5/2013 Holland ..... H01R 24/38 439/583
2013/0149896 A1 * 6/2013 Holland ..... H01R 9/05 439/578
2013/0330967 A1 12/2013 Youtsey
2014/0113486 A1 * 4/2014 Wild ..... H01R 4/029 439/578
2014/0342594 A1 11/2014 Montena
2015/0007246 A1 1/2015 Ariesen
2015/0050825 A1 2/2015 Krenceski et al.
2015/0118901 A1 4/2015 Burris
2015/0162675 A1 6/2015 Davidson, Jr. et al.
2015/0180141 A1 6/2015 Wei
2016/0072204 A1 * 3/2016 Edmonds ..... H01R 9/0521 439/583

* cited by examiner

CONNECTOR WITH A LOCKING MECHANISM, MOVEABLE COLLET, AND FLOATING CONTACT MEANS

CROSS-REFERENCE TO RELATED APPLICATIONS

This application is a divisional of and claims the benefit of U.S. patent application Ser. No. 15/711,170, filed Sep. 21, 2017, which claimed the benefit of U.S. Provisional Application No. 62/397,912, filed Sep. 21, 2016, all of which are hereby incorporated by reference.

FIELD OF THE INVENTION

The present invention relates generally to electrical apparatus, and more particularly to coaxial cable connectors.

BACKGROUND OF THE INVENTION

Coaxial cables transmit radio frequency ("RF") signals between transmitters and receivers and are used to interconnect televisions, cable boxes, DVD players, satellite receivers, modems, and other electrical devices and electronic components. Typical coaxial cables include an inner conductor surrounded by a flexible dielectric insulator, a foil layer, a conductive metallic tubular sheath or shield, and a polyvinyl chloride jacket. The RF signal is transmitted through the inner conductor. The conductive tubular shield provides a ground and inhibits electrical and magnetic interference with the RF signal in the inner conductor.

Coaxial cables must be terminated with cable connectors to be coupled to mating posts of electrical devices. Connectors typically have a connector body, a threaded fitting mounted for rotation on an end of the connector body, a bore extending into the connector body from an opposed end to receive the coaxial cable, and an inner post within the bore coupled in electrical communication with the fitting. Generally, connectors are crimped onto a prepared end of a coaxial cable to secure the connector to the coaxial cable. The connectors must maintain electrical connection and signal shielding with the cable despite rotation, tugging, bending, or other movement of the cable and the connector.

Further, the connectors must mitigate the introduction of interference or ingress noise into the connector and signal pathway. Ingres noise causes a variety of problems, including not just reduced signal quality to the home, but large aggregated return path noise issues at the plant. Without properly seating a connector on a female connector or post, ingress noise can leak into the connector. However, it is difficult to know whether a connector is properly seated on a post; without a tool, some ingress noise is nearly guaranteed. An improved connector that mitigates the introduction of ingress noise is needed.

SUMMARY OF THE INVENTION

A coaxial cable termination device including a barrel having opposed front and rear ends, a collet at the front end of the barrel, and a sleeve mounted over the barrel for reciprocal movement. The sleeve moves between a retracted position, in which the sleeve allows compression of the collet, and an advanced position, in which the sleeve urges compression of the collet. In some embodiments, a locking mechanism locks the sleeve into either of the advanced and retracted positions. In some embodiments, contact means carried loosely within the device maintain contact between the barrel and a mating post to which the device is applied.

The above provides the reader with a very brief summary of some embodiments discussed below. Simplifications and omissions are made, and the summary is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figure 1:
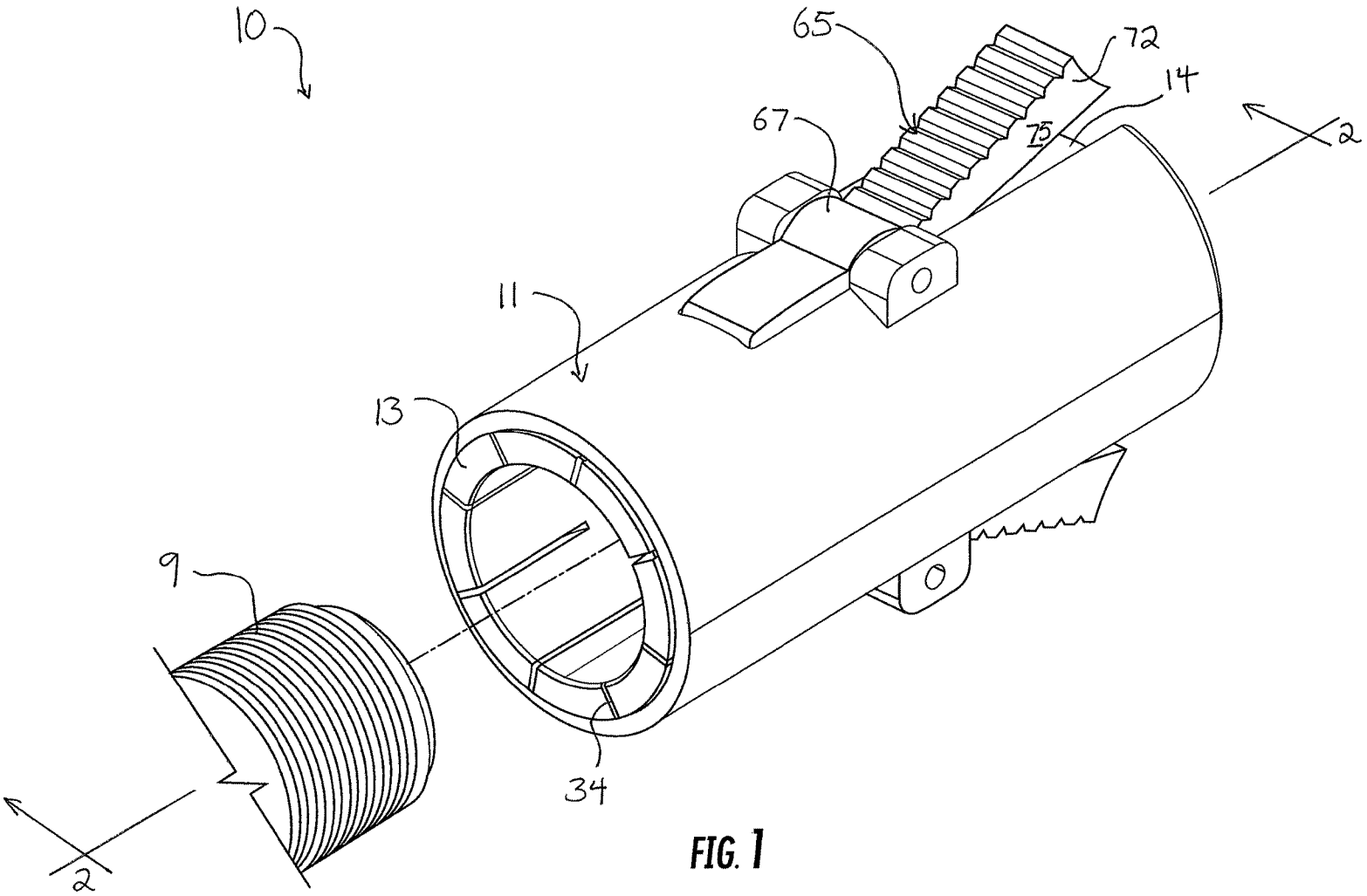
FIG. 1 is a perspective view of a device for terminating a coaxial cable, shown exploded from a mating post of an electronic component, the device including an outer sleeve mounted for reciprocation on a barrel.

Reference now is made to the drawings, in which the same reference characters are used throughout the different figures to designate the same elements. FIG. 1 illustrates a coaxial cable termination device or connector 10 useful for terminating coaxial cables and connecting them to female F-type coaxial mating posts 9 of electronic components. The connector 10 includes a generally cylindrical barrel 12 and an outer sleeve 11 mounted coaxially over the barrel 12 for reciprocation along the barrel 12. Integrally formed in the barrel 12 is a collet 13 and an opposed rear body 14, each of which surrounds a common cylindrical interior 15. As is discussed in detail below, the sleeve 11 reciprocates between retracted and advanced positions over the barrel 12 to allow and prevent expansion of the collet 13, respectively, and to urge the collet 13 into radial compression or deformation and thereby engage the collet 13 securely on a mating post 9.

Figure 2A:
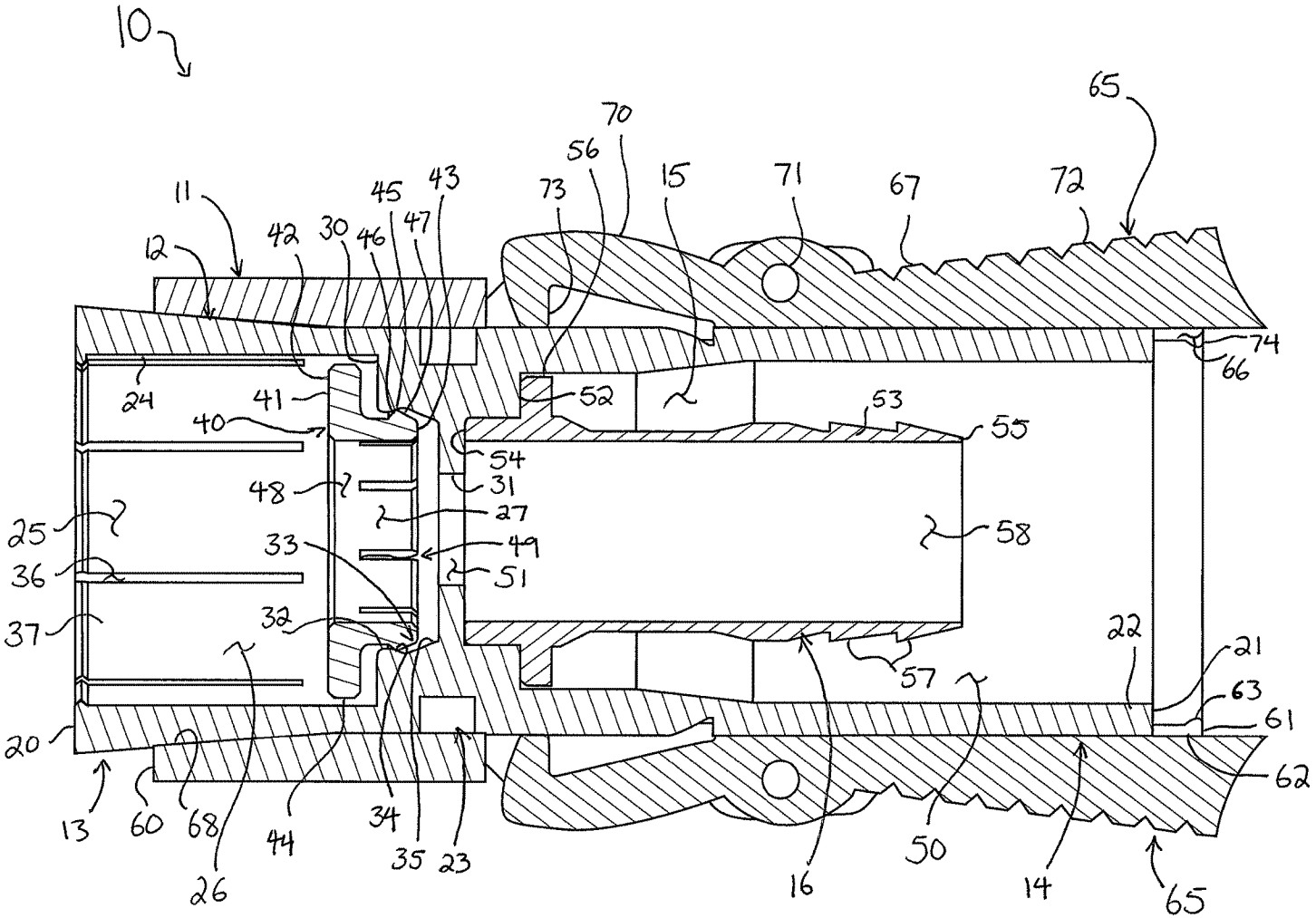
FIGS. 2A and 2B are section views taken along the line 2-2 of FIG. 1, illustrating the sleeve in retracted and advanced positions, respectively.

FIG. 2A illustrates the connector 10 in section view taken along the line 2-2 in FIG. 1. The barrel 12 includes opposed front and rear ends 20 and 21 and a generally cylindrical sidewall 22 extending therebetween. The collet 13 is at the front end 20, the cylindrical rear body 14 is at the rear end 21, and between, a circumferential annular channel 23 is recessed into the sidewall 22 from the outer surface of the barrel 12. The rear body 14 has generally constant inner and outer diameters, while the collet 13 is slightly conical. The collet 13 has an inner diameter which is generally constant from proximate to the annular channel 23 to the front end 20, but the outer diameter of the collet 13 expands slightly from the annular channel 23 to the front end 20, so that the collet 13 is tapered from front to back.

The collet 13 is sized and shaped to engage with the mating post 9 of FIG. 1. The inner diameter of the collet 13 corresponds in size and shape to the mating post 9. The collet 13 includes an inner surface 24 bounding and defining a forward bore 25 for receiving the mating post 9. The forward bore 25 includes a large open forward section 26 and an opposed, smaller rear section 27. The forward section 26 extends from the front end 20 of the collet 13 to an intermediate wall 30; the inner diameter in the forward section 26 is generally constant. The rear section 27, however, extends from the intermediate wall 30 to an interior wall defined by an annular flange 31 extending inwardly from the inner surface 24.

A radially-directed lip 32 extends inwardly at the intermediate wall 30, which lip 32 projects inward past the inner surface 24 in the rear section 27. The inner diameter of the forward bore 25 in the rear section narrows from just behind the lip 32 to the annular flange 31. Between the lip 32 and the annular flange 31, the barrel 12 defines an annular shoulder 33 extending inwardly into the rear section 27 of the forward bore 25. The annular shoulder 33 has a circumferentially concave inner surface; moving rearward from the lip 32, the outer diameter of the annular shoulder 22 increases to an inflection point, at which it decreases to the base of the annular flange 31, at which point it increases to the annular flange 31. In other words, just behind the lip 32, the annular shoulder 33 includes an annular face 34 directed diagonally rearwardly toward the rear end 21 of the barrel 12. That face opposes an annular face 35 directed diagonally forwardly toward the front end 20 of the barrel 12. These opposing faces 34 and 35 create the annular shoulder 33, a type of annular saddle or seat into which a button 40 is set, the button 40 being useful for maintaining electrical contact and continuity, as will be described.

Still referring to FIG. 2A, the collet 13 includes axial slots 36 formed therein, which allow compression of the collet 13 and the front end 20 of the barrel 12. The slots 34 extend rearward from the front end 20 to proximate to the annular channel 23. There are preferably eight slots 34, as shown in FIG. 1, but one having ordinary skill in the art will readily appreciate that there may be a greater or fewer number of slots 34. The slots define fingers 37 of the collet 13, which fingers 37 are flexible and structured to flex in a radial direction. The inner surface 24 of the collet 13 is preferably smooth, and so the inner surfaces of each of the fingers 37 are smooth. In other embodiments, however, the inner surface 24 at the front end 20 has a single thread or ridge, or a plurality of threads or ridges for engaging with corresponding threads on a mating post 9.

Carried within the collet 13 is a small floating element, referred to herein as a "button 40." The button 40 is a contact means, effective at preventing the ingress of noise and interference into the connector 10 by maintain contact between the end of the mating post 9 and the inner surface 24 of the collet 13. It maintains circumferential contact, as will be described, thereby maintain continuous electrical continuity in the connector 10 and around a center conduct applied to the connector 10.

The button 40 is somewhat disc-shaped and includes a body 41 with a front end 42 and a rear end 43. The button 40 is separate from the barrel 12 and the inner post 16; in other words, it is not formed to or attached to the barrel 12 and the inner post 16. Rather, the button 40 floats near them, carried loosely in the forward bore 25 proximate to the annular flange 31 for contact with the barrel 12. At the front end 42, the button 40 has a annular front flange 44 with an outer diameter just smaller than the inner diameter of the collet 13 in front of the intermediate wall 30, so that the front flange 40 is loosely received within the forward section 26 of the forward bore 25. The flange 41 extends radially outwardly from the cylindrical body 41. Near the rear end 43, a small annular lip, or ridge 45, projects radially outwardly from the body 41. The ridge 45 extends outward a distance less than the front flange 44. The ridge 45 has a forwardly-directed diagonal face 46 and an opposed rearwardly-directed diagonal face 47. Between the front flange 44 and the ridge 45, the body 41 of the button 40 has a reduced outer diameter.

The button 40 has a bore 48 extending therethrough which is coaxial to, aligned with, and in communication with the forward and rear sections 26 and 27 of the bore forward 25. Axial slots 49 formed into the body 41 and extending from the rear end 43 to the base of the front flange 44 allow the rear end 43 of the body 41 to flex and compress into the bore 48 radially.

With continuing reference to FIG. 2A, the annular flange 31 separates the interior 15 between the forward bore 25 and a rearward bore 50. The annular flange 31 directly radially opposes the annular channel 23. A hole 51, encircled by the annular flange, is coaxial to the forward and rearward bores 25 and 50 and in open communication with both. The rearward bore 50 is substantially cylindrical. The rearward bore 50 corresponds to the size and shape to a coaxial cable, and the hole 51 corresponds in size and shape to the center conductor and surrounding dielectric of said coaxial cable. The rearward bore 50 is encircled by the rear body 14. The rear body 14 extends rearwardly. The rear body 14 is generally cylindrical and extends from an inner wall 52 to the rear end 21 of the barrel 12. The rear body 14 bounds the rearward bore 50. An inner post 16 is carried coaxially within the rear body 14. The inner post 16 includes a relatively thin sidewall 53 extending from a front end 54 to a back end 55 and having a forward flange 56 proximate to the front end 54, and rear annular barbs 57 proximate to the back end 55. The sidewall 53 of the inner post 16 bounds a bore 58 extending axially entirely through the inner post 16. The forward flange 56, when the inner post 16 is installed in the rear body 14, is flush in contact against the inner wall 52 and extends entirely diametrically within the rear body 14; the inner post 16 is preferably press fit into the rear body 14.

Figure 2B:
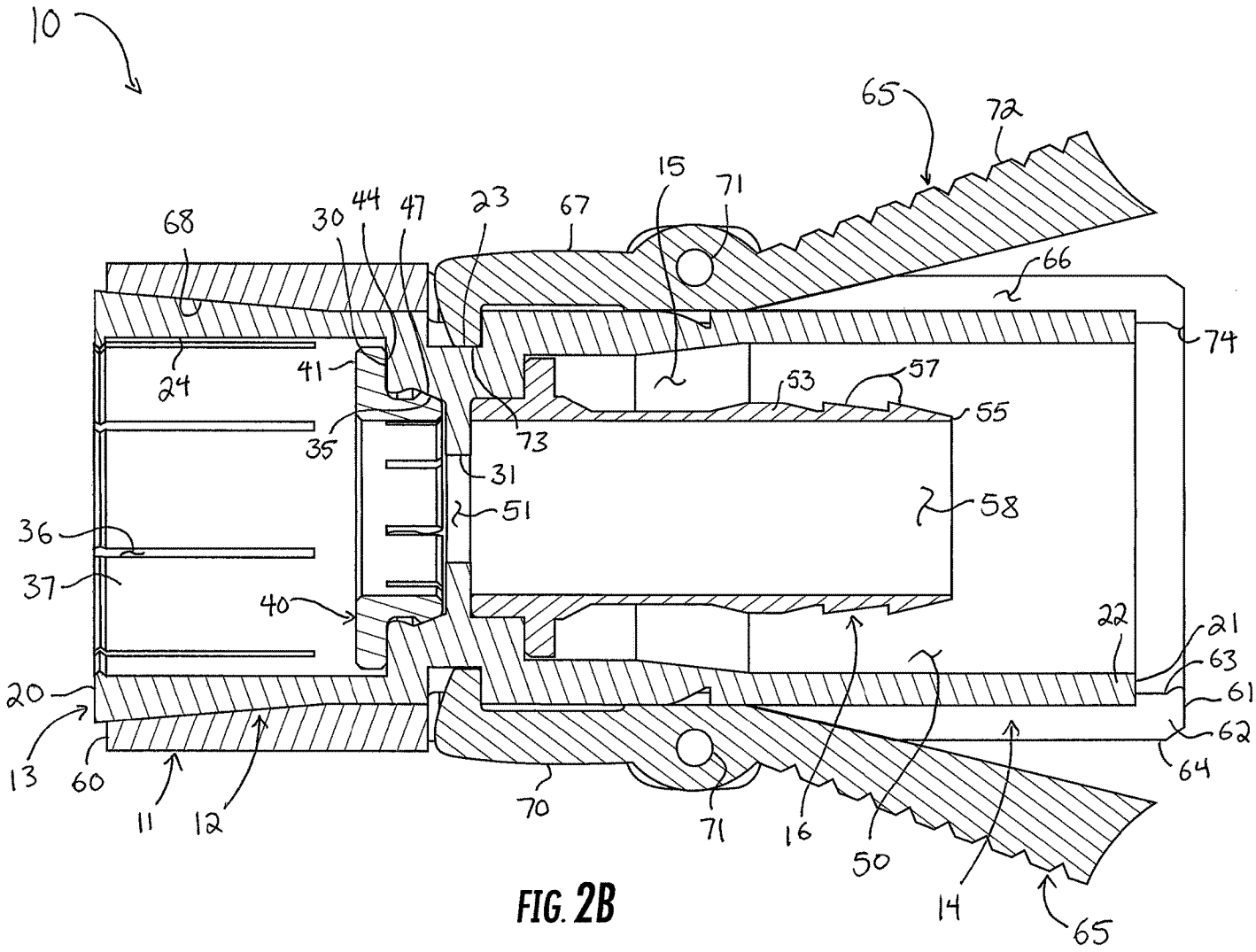

The collet 13 is joined in mechanical communication with the rear body 14 as a single, unitary body. In the embodiment shown in the drawings, the collet 13 is formed integrally and monolithically to the rear body 14, preferably from a common piece of material. The sleeve 11 is carried outside of the barrel 12, and is mounted for reciprocal movement thereon. In FIG. 2A, the sleeve 11 is shown in a retracted position, while FIG. 2B shows the sleeve 11 in an advanced position. The sleeve 11 is useful to force the collet 13 into radial compression. As is explained in greater detail below, when the sleeve 11 is slid forward over the barrel 12, the collet 13 radially compresses, preferably on a mating post 9. Thus, in the retracted position of the sleeve 11, the sleeve 11 allows either radial expansion or radial compression of the collet 13, but in the advanced position of the sleeve 11, the sleeve 11 prevents radial expansion of the collet 13 and urges compression thereof.

The sleeve 11 includes a front 60, an opposed rear 61, and a cylindrical sidewall 62 extending therebetween. The sidewall 62 includes an inner surface 63 and an opposed outer surface 64. The inner surface 63 defines the cylindrical space in which the barrel 12 is received. The inner surface 63 is generally cylindrical, straight, and smooth. However, at the front 60 of the sleeve 11, the inner surface 63 angles slightly radially outwardly, such that there is a chamfer 68 at the front 60 of the sleeve 11. This chamfer 68 provides room for the conical collet 13.

Two locking mechanisms 65 are carried in the sleeve 11 and are useful for locking the sleeve 11 with respect to the barrel 12. The locking mechanisms 65 are identical but for their diametrically opposed locations on the sleeve 11, and as such, only one of the locking mechanisms 65 will be referred to, with the understanding that the description applies equally to both. Further, two locking mechanisms 65 are shown in the drawings, but one having ordinary skill in the art will readily appreciate that other numbers of locking mechanisms 65, such as one, three, four, etc., may be useful depending on the sizes of the connector 10 and cable as well as the desired strength and security of the engagement of the connector 10 on the mating post 9.

The locking mechanism 65 is carried in an axial slot 66 within the sleeve 11, and includes a rocking arm 67 having a jaw 70 projecting forwardly from a pivot 71 and a lever 72 projecting backward from the pivot 71. The locking mechanism 65 is arrangeable between a locked condition, in which the sleeve 11 is prevented from moving out of the advanced position, and an unlocked condition, in which the sleeve 11 is allowed to reciprocate between the advanced and retracted positions. The pivot 71 is a pivot pin carried in the sleeve 11. The rocking arm includes an inwardly-directed tooth 73 at its forward end, oriented normal to the arm 67. The rocking arm 67 moves from an unlocked position (corresponding to the unlocked condition of the locking mechanism 65), shown in FIG. 2A, to a locked position (corresponding to the locked condition of the locking mechanism 65), shown in FIG. 2B. It rocks in this movement, such that the arm 67 and the lever 72 rock about the pivot 71 to move the tooth 73 into and out of the annular channel 23. The rocking arm 67 is biased toward the locked position, such as by torsional springs on the pivot 71. Opposed from the jaw 70, the lever 72 extends outward and is useful to move, or reset, the rocking arm 67 from the locked position to the unlocked position. The lever 72 may be depressed radially inward to move, or rock, the rocking arm 67 radially outward from the locked position to the unlocked position.

At the rear 61 of the sleeve 11, an inwardly-extending lip 74 is formed and defines a mouth at the back of the connector 10. The mouth receives a coaxial cable applied to the connector 10. The lip 74 acts as a stop against the rear end 21 of the barrel 12 to prevent forward movement of the sleeve 11 on the barrel 12 beyond the advanced position of the sleeve 11.

Figure 3A:
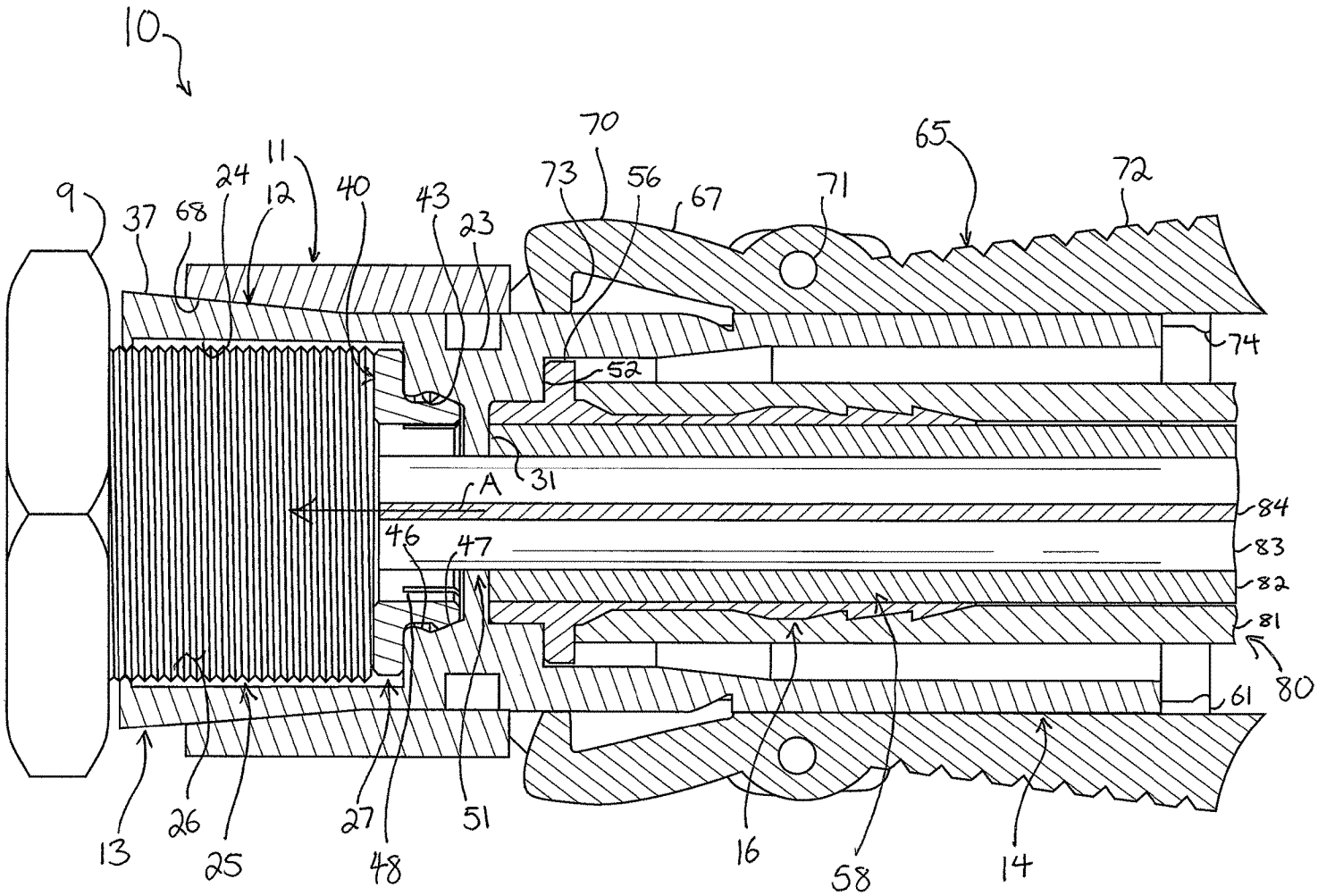
FIG. 3A is a section view taken along the line 2-2 of FIG. 1, illustrating a cable applied to the device, the device applied on a mating post, and the sleeve in the retracted position thereof.

In operation, the connector 10 is useful as a push-on locking connector that can be quickly and easily applied and locked onto a mating post 9, and then securely left in place. To apply the connector 10 to a mating post 9, the connector 10 is first preferably applied to a cable 80. A cable 80, such as a coaxial cable 80, is conventionally prepared, such as by stripping back the jacket 81 and foil and braid 82. The cable 80 is then applied into the connector 10. As shown in FIG. 3A, the cable 80 passes through the mouth defined by the lip 61, and the dielectric 83 and center conductor 84 of the cable 80 pass into the bore 58 inside the inner post 16, while the jacket 81, foil, and braid pass over the inner post 16, between the inner post 16 and the rear body 14. The cable 80 is advanced until the jacket 81 and foil and braid 82 encounter the forward flange 56 and the inner wall 52. The center conductor 84, which is typically prepared to be longer than the dielectric 83, jacket 81, and foil and braid 82, extends through the hole 51, through the bore 48 of the button 40, and into the forward bore 25 of the collet 13. The center conductor thus terminates within the collet 13.

Once so properly prepared, the connector 10 is ready for application to the mating post 9. FIG. 3A shows the connector 10 applied to the mating post 9. The connector 10, with the cable 80 extending out the rear 61, is taken up, such as by hand, and aligned and registered with the mating post 9. With the sleeve 11 in the unlocked position thereof, as shown in FIG. 2A, the connector 10 is advanced along a forward axial direction illustrated by line A of FIG. 3A. While the sleeve 11 is in the unlocked position thereof, and is retracted on the barrel 12, the collet 13 is free to expand and contract or compress radially. The collet 13 is applied over the mating post 9, causing the collet 13 to expand: the slots 34 expand such that the fingers 37 splay radially outward slightly, and the collet 13 passes onto and over the mating post 9. The connector 10 is advanced until the mating post 9 is firmly seated within the forward section 26 of the forward bore 25. The fingers 37 are slightly expanded.

With the mating post 9 seated in the forward bore 25, the front of the mating post 9 is in contact against the front flange 44 of the button 40. The button 40 "floats," such that before a mating post 9 is applied to the collet 13, the button 40 may freely move in an axial direction with the ridge 45 within the rear section 27 of the forward bore 25. When it does, the rear end 43 of the button 40 expands and contracts radially to maintain contact with the annular shoulder 33 of the barrel 12: the slots 49 in the back of the button 40 are slightly compressed and thus the rear end 43 is biased radially outwardly such that they contact and ride against the annular shoulder 33 as the button 40 floats along the axial direction.

The button 40 is biased forward, toward the front end 20 of the barrel 12. The outward bias in the rear end 43 of the button 40 urges the ridge 45 to move into the inflection point between the faces 46 and 47. This urges the button 40 forward along the annular shoulder 33. As such, the button 40 contacts the front of the mating post 9 before the mating post is fully applied to the connector 10. This thus creates electrical continuity between the mating post 9 and the connector 10 even before the mating post 9 is fully captured.

When the front of the mating post 9 is in contact against the front flange 44, and the connector 10 continues to be advanced and applied onto the mating post 9, the mating post 9 pushes the button 40 rearwardly into the rear section 27 of the forward bore 25. When the button 40 is so pushed, the ridge 45 is pressed against the annular shoulder, and the rear end 43 of the button 40 is radially compressed.

Partial engagement of the mating post 9 with the collet 13 thus provides electrical continuity between the two, and seated engagement of the mating post 9 with the collet 13 ensures electrical continuity between the mating post 9 and the button 40 and between the button 40 and the annular shoulder 43. The button 40 is limited in axial movement and forms an annular electrical continuity with the inner surface 24 surrounding the center conductor. This engagement, shown in FIG. 3A, prevents the introduction of outside interference and signals into the connector 10, thereby preserving much of the quality of the RF signal transmitted through the connector 10.

Figure 3B:
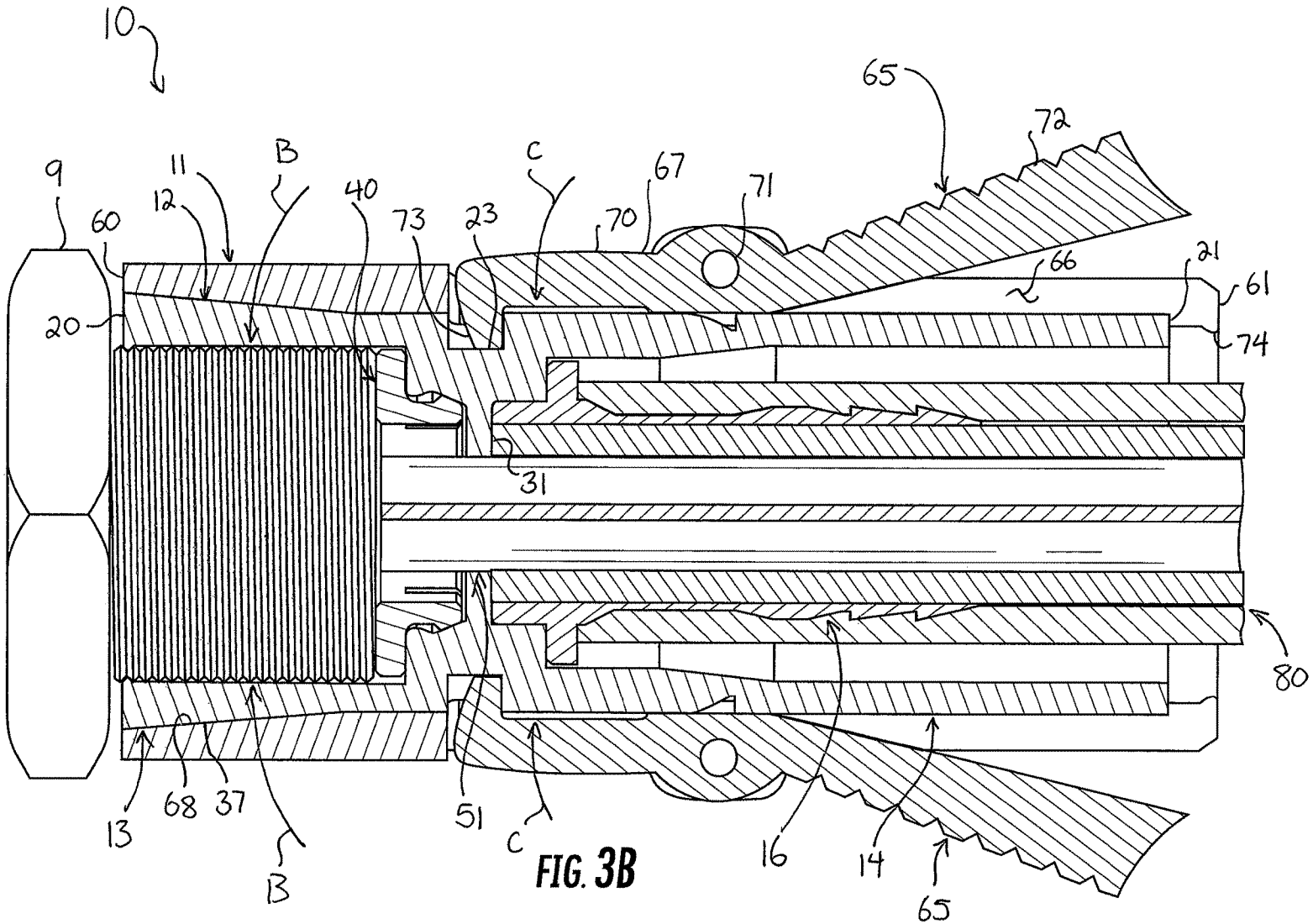
FIG. 3B is a section view taken along the line 2-2 of FIG. 1, illustrating a cable applied to the device, the device applied on a mating post, and the sleeve in the advanced position thereof.

To ensure the security of the engagement of the connector 10 on the mating post 9, the sleeve 11 is moved forward, again along line A, to the advanced position as shown in FIG. 3B. In the advanced position of the sleeve 11, the front 60 of the sleeve 11 is advanced to proximate the front end 20 of the barrel 12, squeezing the barrel 12 inwardly along the lines B in FIG. 2B. The sleeve 11 constricts the collet 13 in a radially inward direction, with the chamfer 68 compressing the collet 13 and causing the collet 13 and the fingers 37 of the collet 13 to deform and compress in a radial inward direction. The fingers 37 deform onto the mating post 9 and bind against the mating post 9, increasing the hold of the connector 10 on the mating post 9. The sleeve 11 prevents expansion of the collet 13, such that the collet 13 cannot release its grip on the mating post 9. In this state, the connector 10 cannot be pulled accidentally off the mating post 9.

In response to the sleeve 11 moving into the advanced position thereof, the locking mechanism 65 automatically locks the sleeve 11 to prevent rearward movement. As the sleeve 11 moves forward, the tooth 73 moves forward until it is disposed over the annular channel 23 formed into the outer surface of the barrel 12.

The arm 67 is biased into the locked position thereof. The jaw 70, biased radially inward, pivots toward and into the annular channel 23, along the arrowed line C in FIG. 3B, in response to the sleeve 11 moving into the advanced position. When the sleeve 11 moves to the advanced position, the front of the slot 66 becomes aligned with the annular channel 23, and the rocking arm 67 pivots so that the tooth 73 moves into the annular channel 23. The tooth 73, biased inwardly by the sprung rocking arm 67, is thus caught in and catches the annular channel 23; the sleeve 11 is prevented from moving axially forward or rearward by the interaction of the tooth 73 in the annular channel 23. This corresponds to a locked position of the connector 10: with the tooth 73 engaged in the annular channel 23, the sleeve 11 is prevented from axial movement rearwardly over the barrel 12, the front 60 of the sleeve cannot be moved back off the collet 13, and the collet 13 is prevented from moving out of compression moving off the mating post 9.

To confirm that the connector 10 is in the locked condition thereof, a visual indicator is exposed. The visual indicator is preferably concealed when the locking mechanism 65 is in the unlocked condition and is exposed when the locking mechanism 65 is in the locked condition, so that a user can quickly determine the locked status of the connector 10. Turning back to FIG. 1, the connector 10 is in the locked position (for clarity, the connector 10 is not shown installed on a mating post 9); the rocking arm 67 is pivoted, the tooth 73 is down into the annular channel 23, and the lever 72 opposed from the rocking arm 67 is up. The lever 72 has a side face 75, which is a visual indicator or may carry a visual indicator. When the lever 72 is up, the side face 75, or a portion thereof, is exposed which is not exposed when the lever 72 is down. The side face 75 preferably carries a color, such as green, which contrasts with the color of the exterior surface of the sleeve 11, which may be black or silver. As such, when the side face 75 (or portion thereof) is exposed and the user can see the color of the side face 75, the connector 10 immediately conveys to the user that the lever 72 is up, the jaw 70 is down, the tooth 73 is in the annular channel 23, and the connector 10 is thus in the locked position thereof. As such, the user can quickly determine whether the connector 10 is locked onto a mating post 9 or loose. In other embodiments, the side face 75 carries another indicator, such as a symbol or word, that allows the user to determine whether the connector 10 is locked.

When the user decides to remove the connector 10 from the mating post 9, the user merely takes up the connector 10, such as by hand, and depresses the lever 72 on each of the locking mechanisms 65, until the lever 72 pivots into the slot 66 and the jaw 70 pivots outward, thereby releasing the tooth 73 from the annular channel 23. The side face 72 of the lever is concealed in the slot 66 so that the color on the side face 75 of the lever 72 is hidden. When the tooth 73 is so released from the annular channel 23, the sleeve 11 can be slid rearward on the barrel 12 into the unlocked position thereof, thereby releasing the collet 13 from compression, and allowing the fingers 37 to spring away from the mating post 9. In this state, the connector 10 can now be removed from the mating post 9.

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof. To the extent that such modifications do not depart from the spirit of the invention, they are intended to be included within the scope thereof.

The invention claimed is:

1. A coaxial cable termination device comprising:

a barrel including opposed front and rear ends, the barrel defining an interior;

an annular flange extending inwardly from the barrel into the interior and separating the interior into a forward bore and a rearward bore;

an inner post carried in the rearward bore; and contact means carried in the forward bore, the contact means separate from the inner post and the barrel, and carried loosely in the forward bore proximate to the annular flange for contact with the barrel.

2. The termination device of claim 1, wherein the contact means includes:

a body coaxial to the barrel and having opposed front and rear ends; and axial slots formed into the body allowing compression of the rear end of the body.

3. The termination device of claim 1, wherein the contact means deforms and maintains contact with the barrel when the termination device is applied to a mating post.

4. The termination device of claim 1, wherein the inner post has a forward end that terminates at and in contact with the annular flange.

5. The termination device of claim 1, wherein the annular flange encircles a coaxial hole in communication with the forward and rearward bores.

6. The termination device of claim 1, wherein the contact means includes:

a body coaxial to the barrel and having opposed front and rear ends;

an annular flange at the front end of the body;

an annular ridge at the rear end of the body; and a reduced outer diameter between the annular flange of the body and the annular ridge.

7. The termination device of claim 6, wherein:

the barrel further includes an annular shoulder extending inwardly from the barrel into the interior proximate to the annular flange; and the annular ridge of the contact means is carried within the annular shoulder, in contact therewith.

8. The termination device of claim 7, wherein:

the contact means further includes axial slots formed into the body allowing compression of the rear end of the body; and in response to the termination device being applied to a mating post, the contact means deforms against the annular shoulder of the barrel and causes the annular ridge of the body of the contact means to maintain contact with the annular shoulder.

* * * * *